US010627115B2

(12) United States Patent
Armstrong

(10) Patent No.: US 10,627,115 B2
(45) Date of Patent: Apr. 21, 2020

(54) COOKTOP APPLIANCE AND TEMPERATURE SWITCH

(71) Applicant: Haier US Appliance Solutions, Inc., Wilmington, DE (US)

(72) Inventor: James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 324 days.

(21) Appl. No.: 15/675,832

(22) Filed: Aug. 14, 2017

(65) Prior Publication Data

US 2019/0049118 A1 Feb. 14, 2019

(51) Int. Cl.
*F24C 7/08* (2006.01)
*H05B 1/02* (2006.01)

(52) U.S. Cl.
CPC ..... *F24C 7/088* (2013.01); *F24C 7/087* (2013.01); *H05B 1/0266* (2013.01); *H05B 2213/04* (2013.01)

(58) Field of Classification Search
CPC ..... F24C 7/08
USPC ..... 99/275, 330, 329 R; 219/393, 414, 432, 219/505
See application file for complete search history.

(56) References Cited

U.S. PATENT DOCUMENTS

| | | | | |
|---|---|---|---|---|
| 3,622,754 | A | 11/1971 | Hurko | |
| 4,755,655 | A * | 7/1988 | Reiche | H05B 3/72 219/448.11 |
| 6,246,033 | B1 * | 6/2001 | Shah | A47J 27/62 219/447.1 |
| 6,753,509 | B2 | 6/2004 | Gratz et al. | |
| 9,220,130 | B1 * | 12/2015 | Smith | H05B 1/0266 |
| 2018/0058700 | A1 * | 3/2018 | Perry | H05B 1/0266 |

FOREIGN PATENT DOCUMENTS

GB 2278237 B 11/1994

* cited by examiner

*Primary Examiner* — Thien S Tran
(74) *Attorney, Agent, or Firm* — Dority & Manning, P.A.

(57) ABSTRACT

A cooktop appliance is provided including a top panel, an electric heating element, a drip pan, and a temperature switch. The drip pan may be attached to the top panel and positioned below the electric heating element. A switch bracket may be mounted to the top panel and may include a cantilevered mounting plate that is biased toward or interferes with the drip pan. The temperature switch may be mounted to the mounting plate using two elongated pins passing through two apertures in the mounting plate such that the temperature switch may pivot relative to the mounting plate and self-align with the drip pan. The temperature switch may be operable to limit the power supplied to the electric heating element at a predetermined temperature.

20 Claims, 8 Drawing Sheets

COOKTOP APPLIANCE AND TEMPERATURE SWITCH

FIELD OF THE INVENTION

The present subject matter relates generally to cooktop appliances, and more particularly to electric cooktop appliances.

BACKGROUND OF THE INVENTION

Cooking appliances, such as, e.g., cooktops or ranges (also known as hobs or stoves), generally include one or more heated portions for heating or cooking food items within a cooking utensil placed on the heated portion. The heated portions utilize one or more heating sources to output heat, which is transferred to the cooking utensil and thereby to any food item or items within the cooking utensil. Typically, a controller or other control mechanism, such as an electromechanical switch, regulates the heat output of the heating source selected by a user of the cooking appliance, e.g., by turning a knob or interacting with a touch-sensitive control panel. For example, the control mechanism may cycle the heating source between an activated or on state and a substantially deactivated or off state such that the average heat output of the heating source corresponds to the user-selected heat output level.

The control mechanism can utilize a temperature sensor to help control the heat output in order to regulate or otherwise limit the cooking utensil from reaching an undesired temperature level. The transfer of heat to the cooking utensil and/or food items may cause the food items or cooking utensil to overheat or otherwise cause unwanted and/or unsafe conditions on the cooktop. However, such temperature sensors may be ineffective at accurately measuring or estimating the temperature of the heating element or the cooking utensil placed thereon.

As a result, certain cooking appliances include a safety temperature switch the is placed in contact with or in close proximity to the drip pan to provide a more accurate temperature measurement and to turn off the heating element when an undesired temperature level is reached. However, such temperature switches are often not properly aligned with the surface of the drip pan, resulting in accurate or varying temperature measurements.

Accordingly, a cooktop appliance having a system for accurately detecting temperature conditions near a heat source would be desirable. More particularly, it may be desirable for a cooktop appliance to have a system that addresses one or more of the conditions discussed above.

BRIEF DESCRIPTION OF THE INVENTION

The present disclosure relates generally to a cooktop appliance including a top panel, an electric heating element, a drip pan, and a temperature switch. The drip pan may be attached to the top panel and positioned below the electric heating element. A switch bracket may be mounted to the top panel and may include a cantilevered mounting plate that is biased toward or interferes with the drip pan. The temperature switch may be mounted to the mounting plate using two elongated pins passing through two apertures in the mounting plate such that the temperature switch may pivot relative to the mounting plate and self-align with the drip pan. The temperature switch may be operable to limit the power supplied to the electric heating element at a predetermined temperature. Aspects and advantages of the invention will be set forth in part in the following description, or may be obvious from the description, or may be learned through practice of the invention.

In one aspect of the present disclosure, a cooktop appliance is provided including a top panel and an electric heating element positioned at the top panel. A drip pan is attached to the top panel and is positioned below the electric heating element and a switch bracket is attached to the top panel. A temperature switch is operably coupled to the electric heating element to limit the power supplied to the electric heating element at a predetermined temperature, the temperature switch being mounted to the switch bracket by one or more elongated pins, each elongated pin passing through an aperture in the switch bracket such that the temperature switch engages the drip pan.

In another aspect of the present disclosure, a cooktop appliance is provided including a top panel and an electric heating element positioned at the top panel. A drip pan is attached to the top panel and is positioned below the electric heating element. A switch bracket is attached to the top panel and extends toward the drip pan, the switch bracket including a cantilevered mounting plate defining two apertures spaced apart along a pivot axis. A temperature switch is mounted to the mounting plate by two elongated pins passing through the two apertures, each elongated pin defining a pin length that is greater than a thickness of a mounting plate of the switch bracket such that the temperature switch may pivot along the pivot axis to self-align with the drip pan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
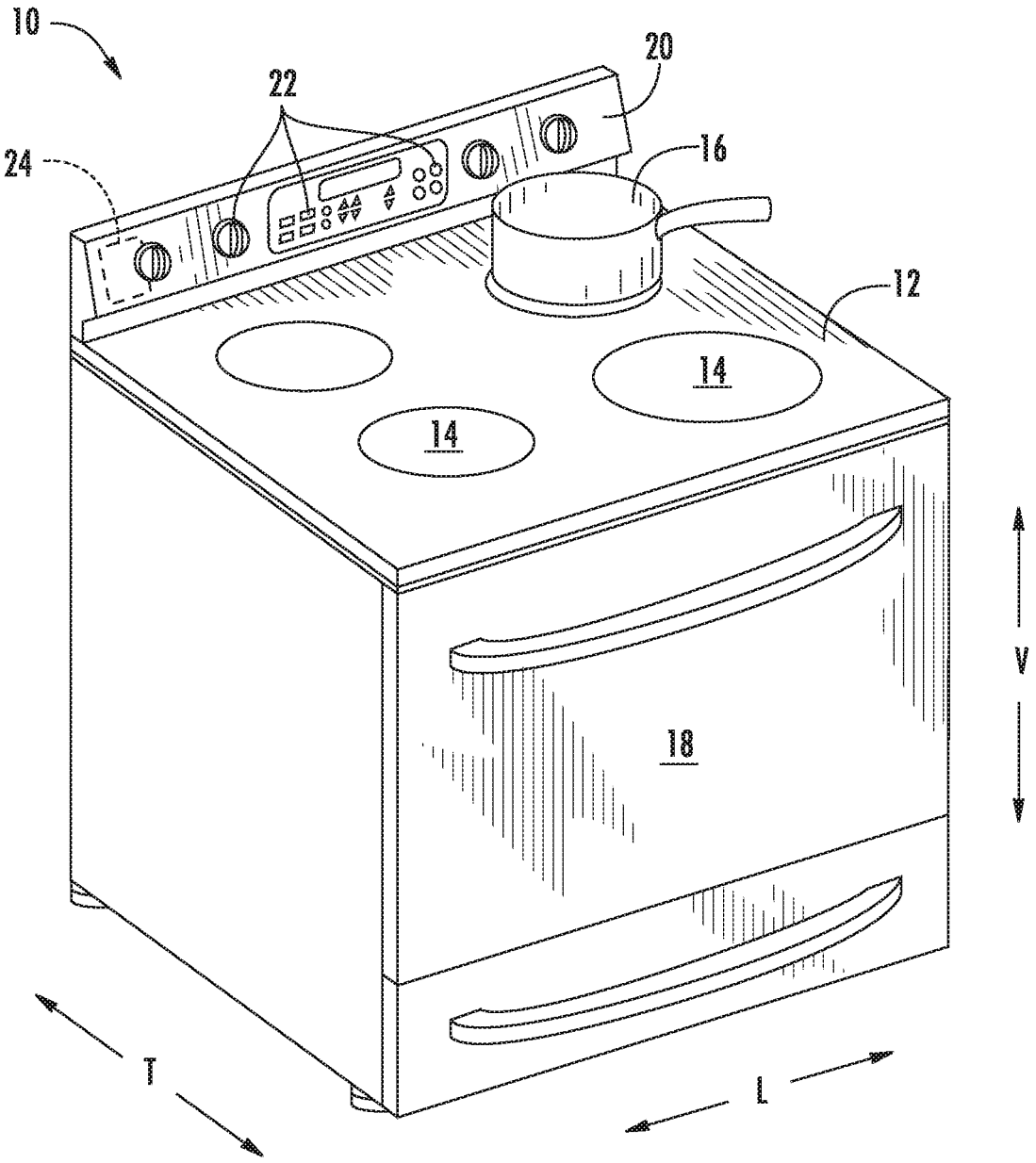
FIG. 1 provides a perspective view of a cooktop appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a cooktop appliance that includes at least one heating assembly. The heating assembly may have one or more electric heating elements and a drip pan that is positioned below the electric heating element(s). A temperature switch may touch the drip pan to detect the heat transmitted from the electric heating element(s). When the temperature switch detects a certain temperature, it may restrict or cut off a voltage to one or more of the electric heating elements. If and/or when the temperature falls by a sufficient amount, the temperature switch may permit or direct the voltage to the electric heating element(s).

Turning now to the figures, FIG. 1 provides a perspective view of an exemplary cooktop appliance 10. Generally, cooktop appliance 10 defines a vertical direction V, a lateral direction L, and a transverse direction T. Each of the vertical direction V, lateral direction L, and transverse direction T may be mutually orthogonal to each other. As illustrated in FIG. 1, cooktop appliance 10 may be a range appliance that includes a horizontal cooking surface, such as a top panel 12, disposed on and/or vertically above an oven cabinet. However, cooktop appliance 10 is provided by way of example only and is not intended to limit the present subject matter to any particular appliance or cooktop arrangement. Thus, the present subject matter may be used with other cooktop appliance configurations, e.g., cooktop appliances without an oven. Further, the present subject matter may be used in any other suitable appliance.

Top panel 12 may be constructed of any suitable material, e.g., a ceramic, enameled steel, or stainless steel. As shown in FIG. 1, top panel 12 of cooktop appliance 10 includes one or more heating assemblies 14. In addition, a cooking utensil 16, such as a pot, kettle, pan, skillet, or the like, may be placed or positioned on heating assembly 14 to cook or heat food items placed within cooking utensil 16. In some embodiments, cooktop appliance 10 includes a door 18 that permits access to a cooking chamber (not shown) of the oven cabinet of cooktop appliance 10, the cooking chamber for cooking or baking of food or other items placed therein.

Exemplary embodiments include a user interface 20 having one or more control inputs 22 that permit a user to make selections for cooking of food items using heating assemblies 14 and/or the cooking chamber. As an example, a user may manipulate one or more control inputs 22 to select, e.g., a power or heat output setting for each heating assembly 14. The selected heat output setting of heating assembly 14 affects the heat transferred to cooking utensil 16 positioned on heating assembly 14. Although shown on a backsplash or back panel of cooktop appliance 10, user interface 20 may be positioned in any suitable location, e.g., along a front edge of the appliance 10. Control inputs 22 may include one or more buttons, knobs, or touch screens, as well as combinations thereof.

Some embodiments further include a controller 24 operably connected, e.g., electrically coupled, to user interface 20 and/or control inputs 22. Generally, operation of cooktop appliance 10, including heating assemblies 14, may be controlled by controller 24. In some embodiments, controller 24 is a processing device and may include a microprocessor or other device that is in operable communication with components of cooktop appliance 10, such as heating assembly 14. Controller 24 may include a memory and microprocessor, such as a general or special purpose microprocessor operable to execute programming instructions or micro-control code associated with a selected heating level, operation, or cooking cycle. The memory may represent random access memory such as DRAM, and/or read only memory such as ROM or FLASH. In one embodiment, the processor executes programming instructions stored in memory. The memory may be a separate component from the processor or may be included onboard within the processor.

Alternatively, controller 24 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control inputs 22 and other components of cooktop appliance 10 may be in communication with (e.g., electrically coupled to) controller 24 via one or more signal lines or shared communication busses.

Operation of heating assembly 14 may be regulated such that the temperature or heat output of heating assembly 14 corresponds to a temperature or heat output selected by a user of cooktop appliance 10. In this regard, for example, a user of cooktop appliance 10 may, e.g., manipulate a control 22 associated with a heating assembly 14 to select a desired heat output or temperature. As illustrated, heating assembly 14 includes one or more electric heating elements 30 that are coupled to a power source 32. In general, power source 32 passes electrical energy through heating elements 30 in a manner that generates thermal energy to transfer to cooking utensil 16. The amount of electrical energy provided may be regulated, e.g., by controller 24, to control the output of heat energy from heating element 30.

According to one exemplary embodiment, heating elements 30 may be cycled between an activated state and a deactivated state, i.e., between on and off, such that the average temperature or heat output over each cycle corresponds to or approximates the selected temperature or heat output. In this regard, a duty cycle of heating element 30 may be controlled such that, based on the user's selection, heating element 30 is activated or turned on for a fraction or portion of the operating cycle and deactivated or turned off for the remainder of the operating cycle. For example, if the user selects the midpoint heat output or temperature, the duty cycle of heating element 30 may be controlled to 50% such that heating element 30 is on for half of the operating cycle and off for half of the operating cycle.

Figure 2:
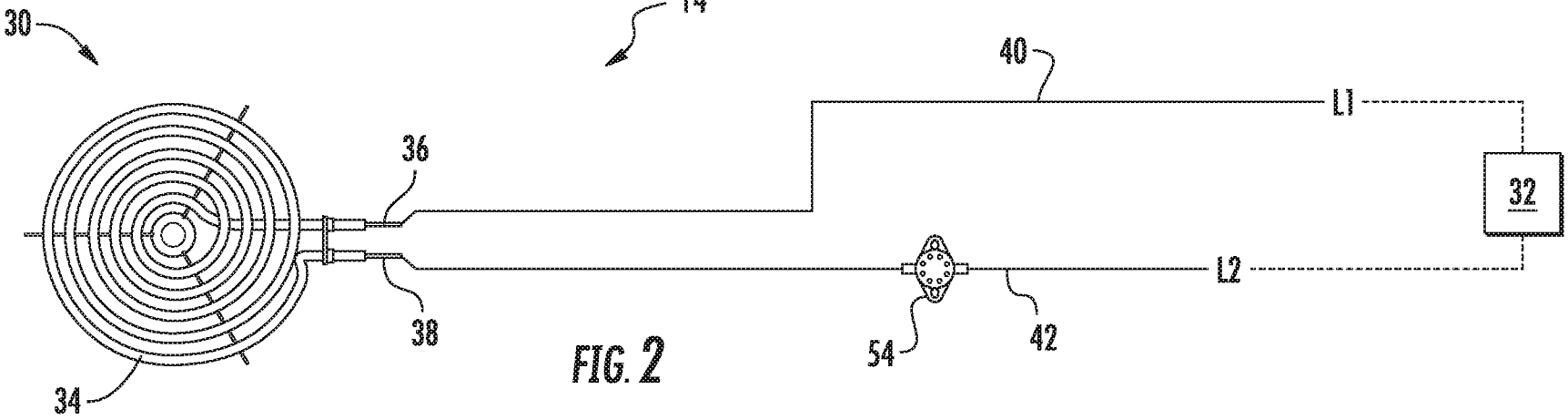
FIG. 2 provides a schematic view of a heating assembly of the exemplary cooktop appliance of FIG. 1 according to exemplary embodiments of the present disclosure, wherein a temperature switch is provided in an activated state.
Figure 3:
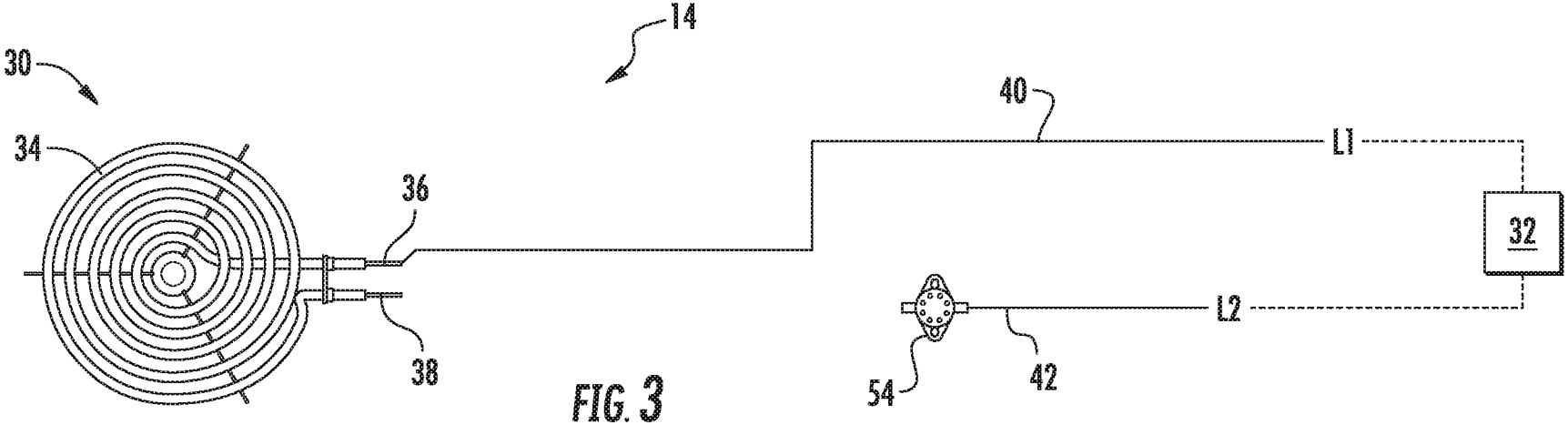
FIG. 3 provides a schematic view of the exemplary heating assembly of FIG. 2, wherein the temperature switch is provided in a deactivated state.
Figure 7:
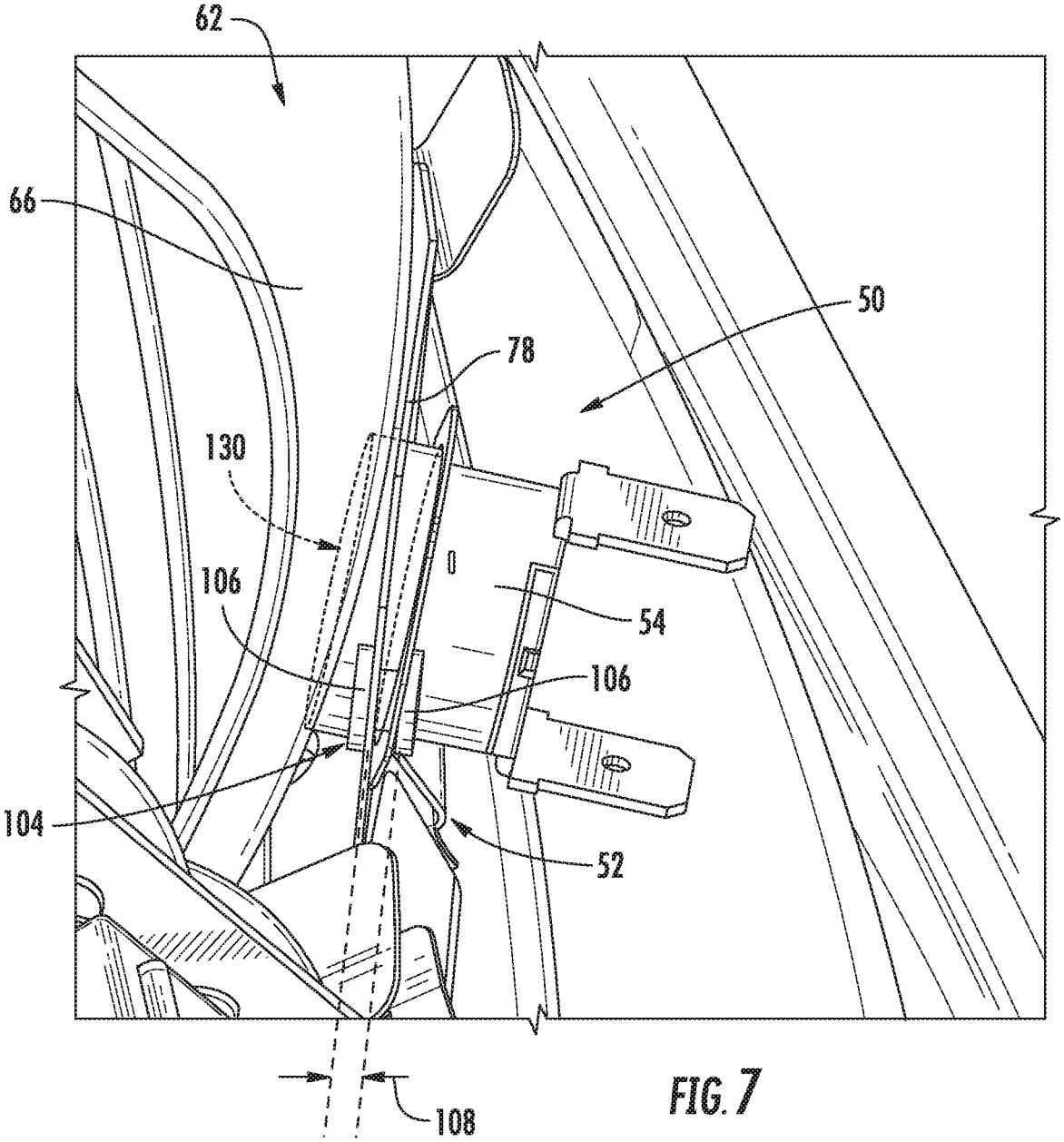
FIG. 7 provides another perspective view of the exemplary switch assembly of FIG. 6.

As illustrated in FIGS. 2 and 3, according to some exemplary embodiments, heating element includes a single spiral shaped resistive coil 34 for providing heat to a cooking utensil 16 positioned thereon. By contrast, according to alternative embodiments, such as illustrated in FIG. 7, heating element 30 may include two resistive coils 34. According to still other embodiments, any suitable number, size, and configurations of resistive coils 34 may be used. In certain such embodiments, heating assembly 14 (FIG. 1) utilizes exposed, electrically-heated, planar coils that are helically-wound about a center point. Coils act as a heat source, i.e., as electric heating element 30, for heating cooking utensils 16 placed directly on heating assembly 14. Each heating assembly 14 may be operably connected to controller 24, e.g., at one or more respective terminal pairs, as described below.

It should be appreciated that the heating assembly 14 illustrated in FIGS. 2 and 3 is an exemplary heating assembly used only for the purpose of explanation and is not intended to limit the scope of the present subject matter. For example, although heating element 30 is illustrated as including a single resistive coil 34 forming a spiral shape by winding in coils around a center point, resistive coil 34 may have a different number of turns, other shapes, or other configurations as well. Moreover, heating assemblies 14 may have any suitable shape, size, and number of defined heating coils, zones, and configurations. Optionally, each heating assembly 14 of cooktop appliance 10 (FIG. 1) may be heated by the same type of heating source, or cooktop appliance 10 may include a combination of different types of heating sources. Cooktop appliance 10 may include a combination of heating assemblies 14 of different shapes and sizes.

Referring now to FIGS. 2 and 3, the configuration and operation of heating assembly 14 will be described according to one exemplary embodiment of the present subject matter. As illustrated, heating element 30 includes a single, spirally-wound resistive coil 34 that terminates in a first terminal 36 and a second terminal 38. An electrical current may be transmitted to resistive coil 34 at the terminals 36, 38. When a voltage differential is applied across first and second terminals 36, 38 of resistive coil 34, a temperature of electric heating element 30 increases. Resistive coil 34 may be a CALROD® coil in certain exemplary embodiments.

Referring still to FIGS. 2 and 3, heating assembly 14 may include a plurality of electrical supply wires or cables for providing power to heating element 30, e.g., from power source 32. More specifically, as illustrated, a first electrical conduit 40 is coupled to first terminal 36 of electric heating element 30. First electrical conduit 40 is configured for operating at a first voltage, L1, with respect to ground. Thus, first electrical conduit 40 may be coupled or connected to a first voltage source, e.g., a first terminal (not shown) on power source 32 which operates at the first voltage L1 with respect to ground. Cooktop appliance 10 also includes a second electrical conduit 42 configured for operating at a second voltage, L2, with respect to ground. Thus, second electrical conduit 42 may be coupled or connected to a second voltage source, e.g., a second terminal (not shown) on power source 32 which operates at the second voltage L2 with respect to ground. The first and second electrical conduits 40, 42 may be any suitable electrical conduits, such as wires, cables, etc.

According to an exemplary embodiment, the first voltage L1 and the second voltage L2 may have opposite polarities. In addition, a magnitude of the first voltage L1 with respect to ground may be about equal to a magnitude the second voltage L2 with respect to ground. As used herein, the term "about" corresponds to within ten volts of a stated voltage when used in the context of voltage. As an example, the magnitude of the first and second voltages L1, L2 may be about one hundred and twenty volts with respect to ground. Thus, e.g., first electrical conduit 40 may be coupled to one phase of a two-hundred and forty volt household electrical supply, and second electrical conduit 42 may be coupled to the second phase of the two-hundred and forty volt household electrical supply.

As illustrated generally in FIGS. 2 through 9, according to an exemplary embodiment, cooktop appliance 10 further includes a switch assembly 50 which is generally provided as a safety mechanism separate from the controller 24. As will be described in more detail below, switch assembly 50 generally includes a switch bracket 52 that is configured for holding a temperature switch 54 in a position suitable for detecting the temperature of one or more components of cooktop appliance 10. In this manner, temperature switch 54 may generally act as a fail-safe mechanism for restricting or terminating the flow of power to heating element 30 in the event a certain condition occurs, e.g., such as the temperature of a certain component exceeding a predetermined threshold temperature.

Generally, temperature switch 54 may be positioned such that a temperature of temperature switch 54 corresponds to a temperature of heating assembly 14, cooking utensil 16, or another component of cooktop appliance 10. When the temperature of that component exceeds a desired temperature, temperature switch 54 may take corrective action. For example, temperature switch 54 may generally be operable to restrict a voltage to electric heating element 30 when a predetermined temperature threshold is reached or exceeded.

According to exemplary embodiments, temperature switch 54 is a bimetallic switch configured for switching from a first state (e.g., a closed or activated state as illustrated in FIG. 2) to a second state (e.g., an open or deactivated state as illustrated FIG. 3), based on the detected temperature. In this regard, bimetallic temperature switch 54 actuates or adjusts from the first state to the second state when the temperature of bimetallic switch 54 exceeds a threshold temperature. Thus, the materials of bimetallic switch 54 may be selected such that bimetallic temperature switch 54 triggers or trips at the threshold temperature. The threshold temperature may be any suitable temperature as desired by the user, set by the manufacturer, required by government regulations, etc. For example, the threshold temperature may be about three hundred and twenty-five degrees Celsius. As another example, the threshold temperature may be between about ninety degrees Celsius and about four hundred degrees Celsius. As used herein, the term "about" corresponds to within twenty-five degrees of a stated temperature when used in the context of temperature.

Referring still to FIGS. 2 and 3, temperature switch 54 may be connected to second electrical conduit 42 in series between second terminal 38 and second voltage L2. As described above, temperature switch 54 may selectively adjust between a first and second state. Accordingly, temperature switch 54 may selectively couple or connect second terminal 38 to second electrical conduit 42. By selectively coupling or connecting the second terminal 38 of electric heating element 30 to second electrical conduit 42, a power output of electric heating element 30 may be regulated with temperature switch 54. Although temperature switch 54 is described as switching between an activated and deactivated state, it should be appreciated that according to alternative embodiments, temperature switch 54 could be any suitable voltage regulation device for reducing or limiting an applied voltage or power level to heating element 30.

Figure 4:
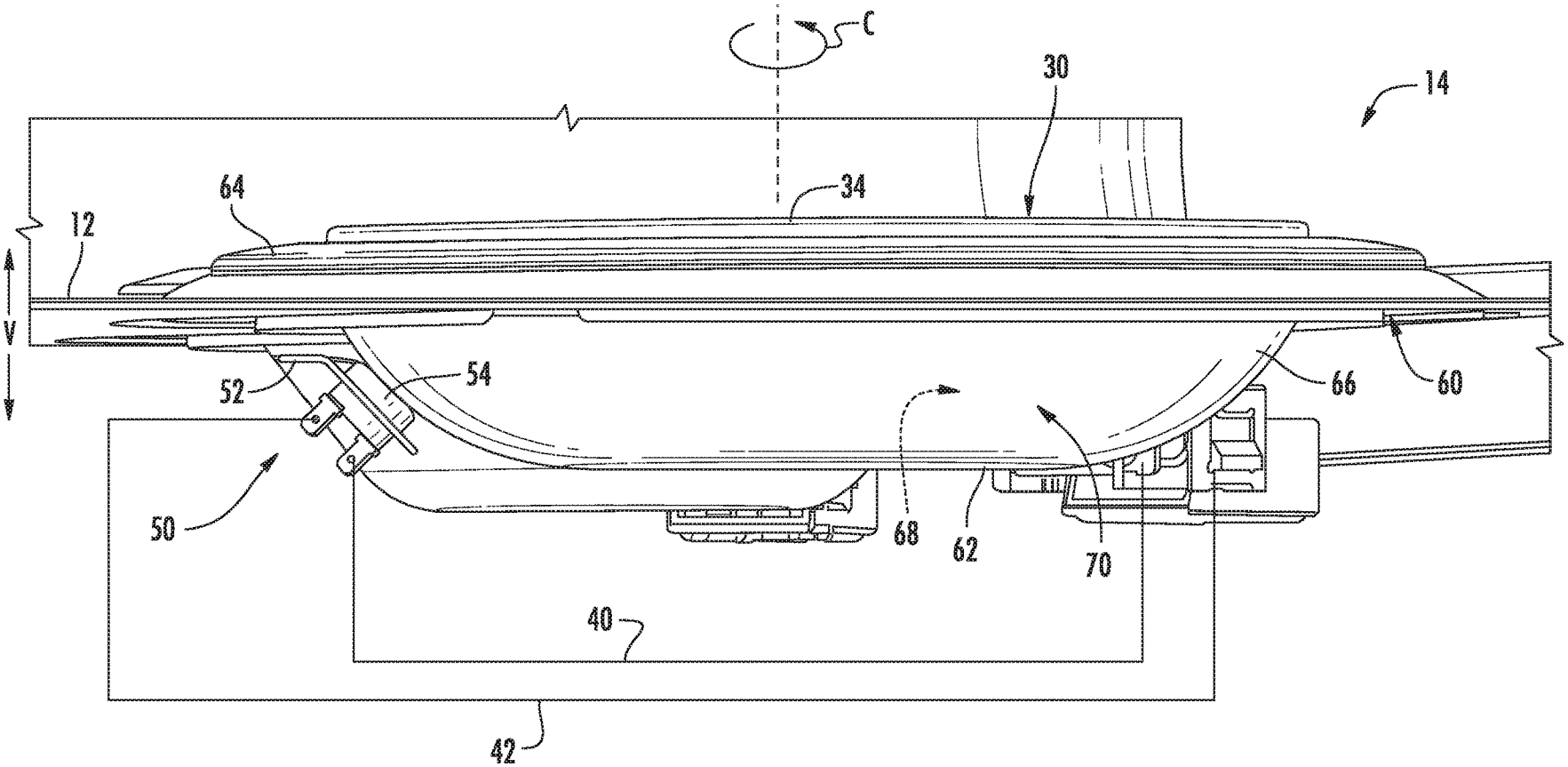
FIG. 4 provides a side perspective view of the exemplary heating assembly of FIG. 2 in the exemplary cooktop appliance of FIG. 1 according to exemplary embodiments of the present disclosure.
Figure 5:
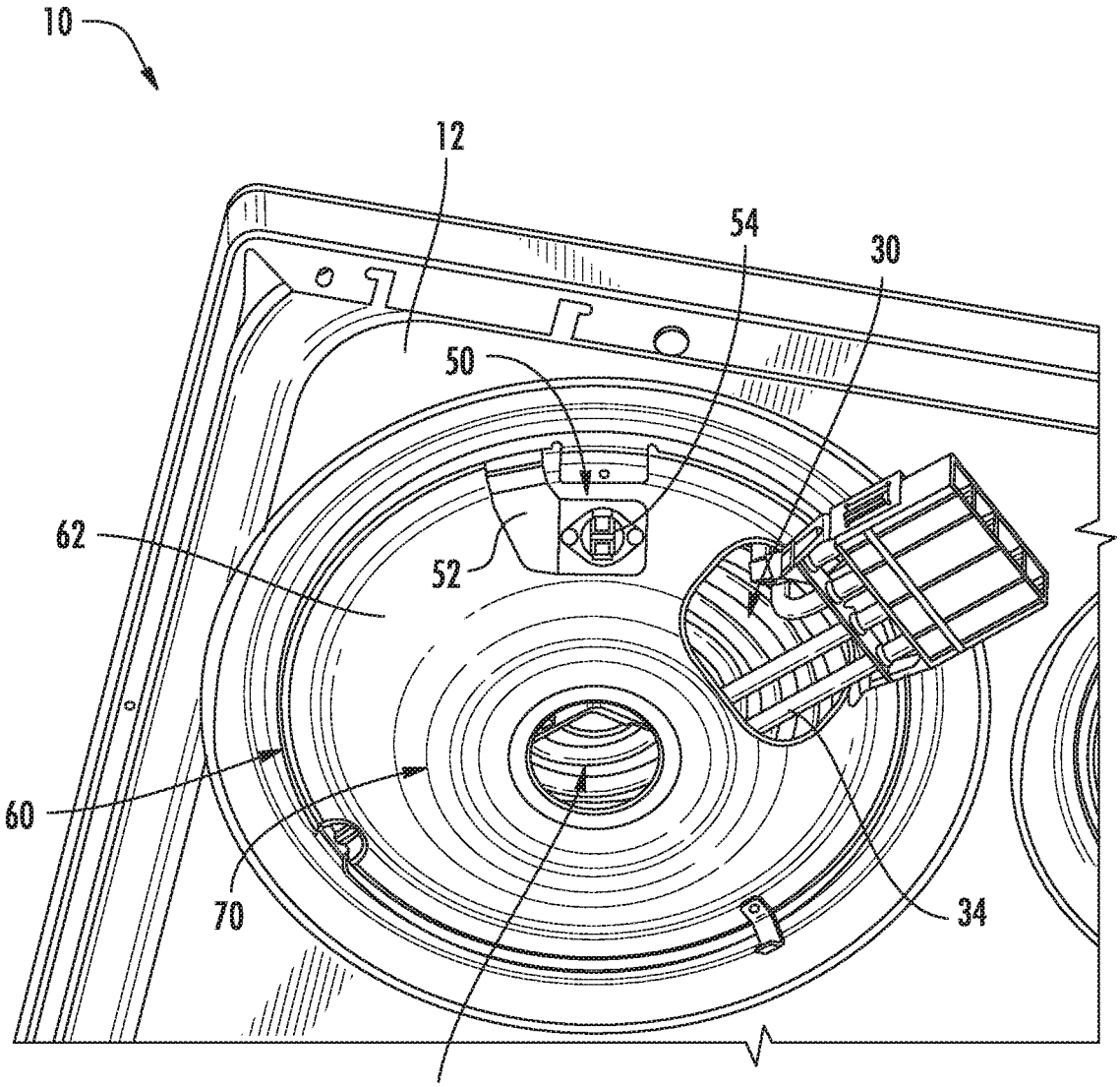
FIG. 5 provides a bottom perspective view of the exemplary heating assembly of FIG. 2.
Figure 6:
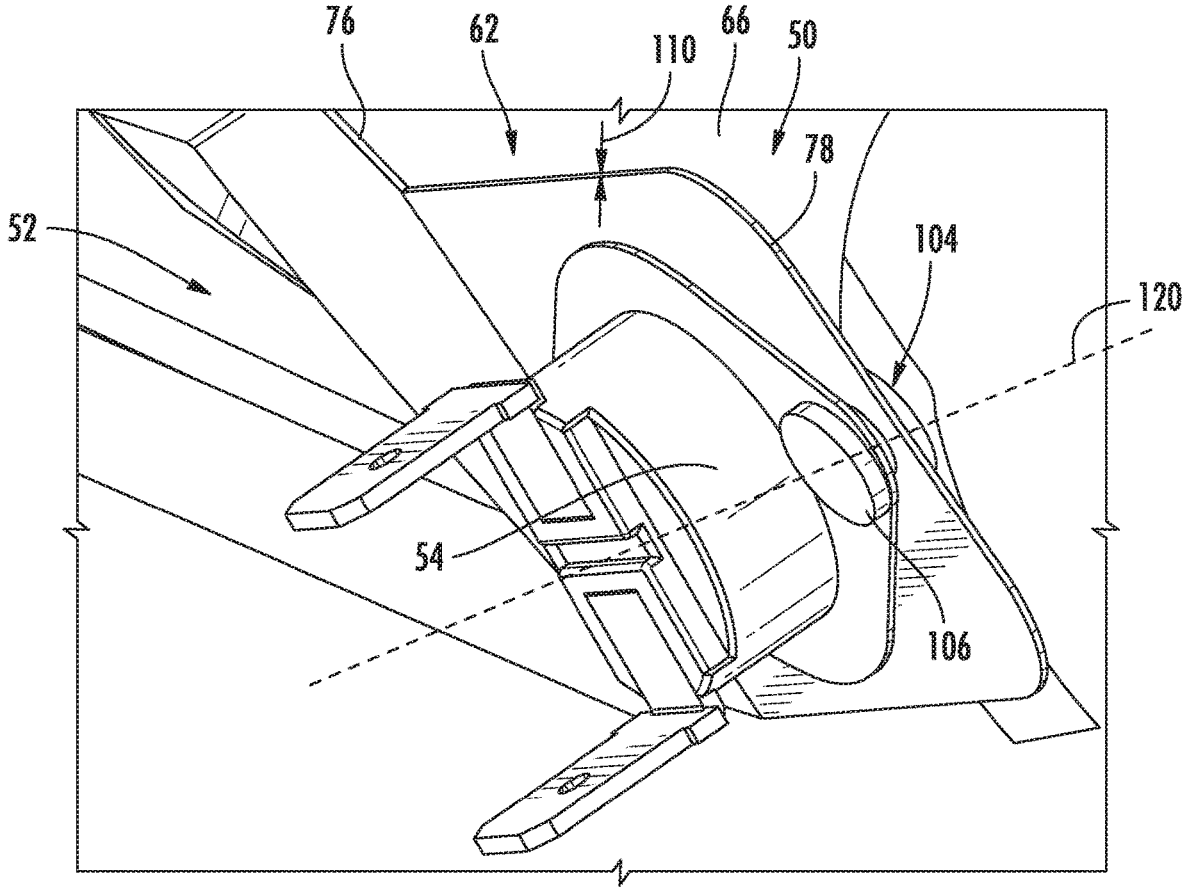
FIG. 6 provides a perspective view of a switch assembly as used in the exemplary cooktop appliance of FIG. 1 according to an exemplary embodiment of the present subject matter.

Turning now to FIGS. 4 and 5, an exemplary heating assembly 14 is illustrated as installed in cooktop appliance 10. As shown, electric heating element 30 positioned at top panel 12. For instance, at least a portion of electric heating element 30 may be positioned above a hole 60 defined through top panel 12. A drip pan 62 may be attached, e.g., removably attached, to top panel 12 below electric heating element 30. In some embodiments, drip pan 62 includes a support lip 64 extending along a circumferential direction C to rest on a top surface of top panel 12, e.g., about hole 60. When mounted, a concave sidewall 66 may extend below top panel 12. For example, a portion of concave sidewall 66 may extend through hole 60 from support lip 64. Concave sidewall 66 may include an inner surface 68 facing the hole 60 and/or electric heating element 30. An outer surface 70 of concave sidewall 66 may be positioned opposite inner surface 68 to face away from hole 60 and/or electric heating element 30. A pan aperture 72 may be defined at a bottom portion of concave sidewall 66 to extend therethrough from inner surface 68 to outer surface 70.

Notably, conventional temperature switches are configured to engage drip pan 62 to ensure safe operating temperatures. However, because drip pan 62 is removable and may vary in size, and because the positioning of temperature switch 54 is not always consistent, the temperature detected by temperature switch 54 may vary undesirably, resulting in dangerous temperature conditions or frequent false trips. Therefore, according to an exemplary embodiment of the present subject matter, an improved switch assembly 50 is provided which ensures proper contact of temperature switch 54 onto drip pan 62 at all times. An exemplary embodiment or such a switch assembly 50 will be described below.

Referring to the illustrated embodiment, switch bracket 52 is attached to cooktop appliance 10, e.g., at top panel 12 and extends toward drip pan 62. Switch bracket 52 is generally configured for holding temperature switch 54 in contact with drip pan 62. More specifically, switch bracket 52 generally includes a mounting flange 74 that is mounted to top panel 12 using any suitable mechanical fastener, such as screws, bolts, rivets, etc. Similarly, glue, bonding, snap-fit mechanisms, interference-fit mechanisms, or any suitable combination thereof be used to join mounting flange 74 and top panel 12. Switch bracket 52 further includes a resilient arm 76 that extends from mounting flange 74 toward drip pan 62. At the end of resilient arm 76, switch bracket 52 includes a mounting plate 78 configured for receiving temperature switch 54 as described below. In this manner, mounting plate 78, and thus temperature switch 54, is cantilevered, extending from top panel 12 and being biased against drip pan 62.

In this manner, resilient arm 76 may generally bias towards drip pan 62, such that when drip pan 62 is installed in hole 60, mounting plate 78 is deflected to ensure proper contact between temperature switch 54 and drip pan 62. More specifically, for example, in a non-engaged state, e.g., when drip pan 62 has been removed from hole 60, resilient arm 76 may hold temperature switch 54 beneath the vertical footprint of hole 60. In an engaged state, e.g., when drip pan 62 has been attached to top panel 12, drip pan 62 may engage temperature switch 54 and deflect resilient arm 76.

More specifically, referring now also to FIGS. 6 through 9, resilient arm 76 is bent to define a first segment 80 and a second segment 82. First segment 80 and second segment 82 generally extend along different directions, or more particularly along a first axis 84 and a second axis 86 not parallel to first axis 84. For example, as illustrated, first segment 80 extends from top panel 12 downward along the vertical direction V. In addition, second segment 82 extends generally along the circumferential direction C. In this manner, resilient arm 76 can flex along two or more pivot axes or within two planes. Although resilient arm 76 is illustrated as being attached directly to top panel 102, it should be appreciated that it could instead be mounted to any other suitable support member disposed below drip pan 62.

According to the illustrated embodiment, temperature switch 54 is disposed on mounting plate 78 such that temperature switch 54 engages the drip pan 62. More specifically, for example, mounting plate 78 may define a receiving hole 100 for receiving temperature switch 54. In addition, mounting plate 78 may define one or more apertures 102 configured for receiving elongated pins 104 that mount temperature switch 54 to mounting plate 78. More specifically, according to the illustrated embodiment, mounting plate defines two apertures 102 and temperature switch 54 is mounted using two elongated pins 104. However, it should be appreciated that any suitable number and size of apertures 102 and pins 104 may be used according to alternative embodiments.

Figure 8:
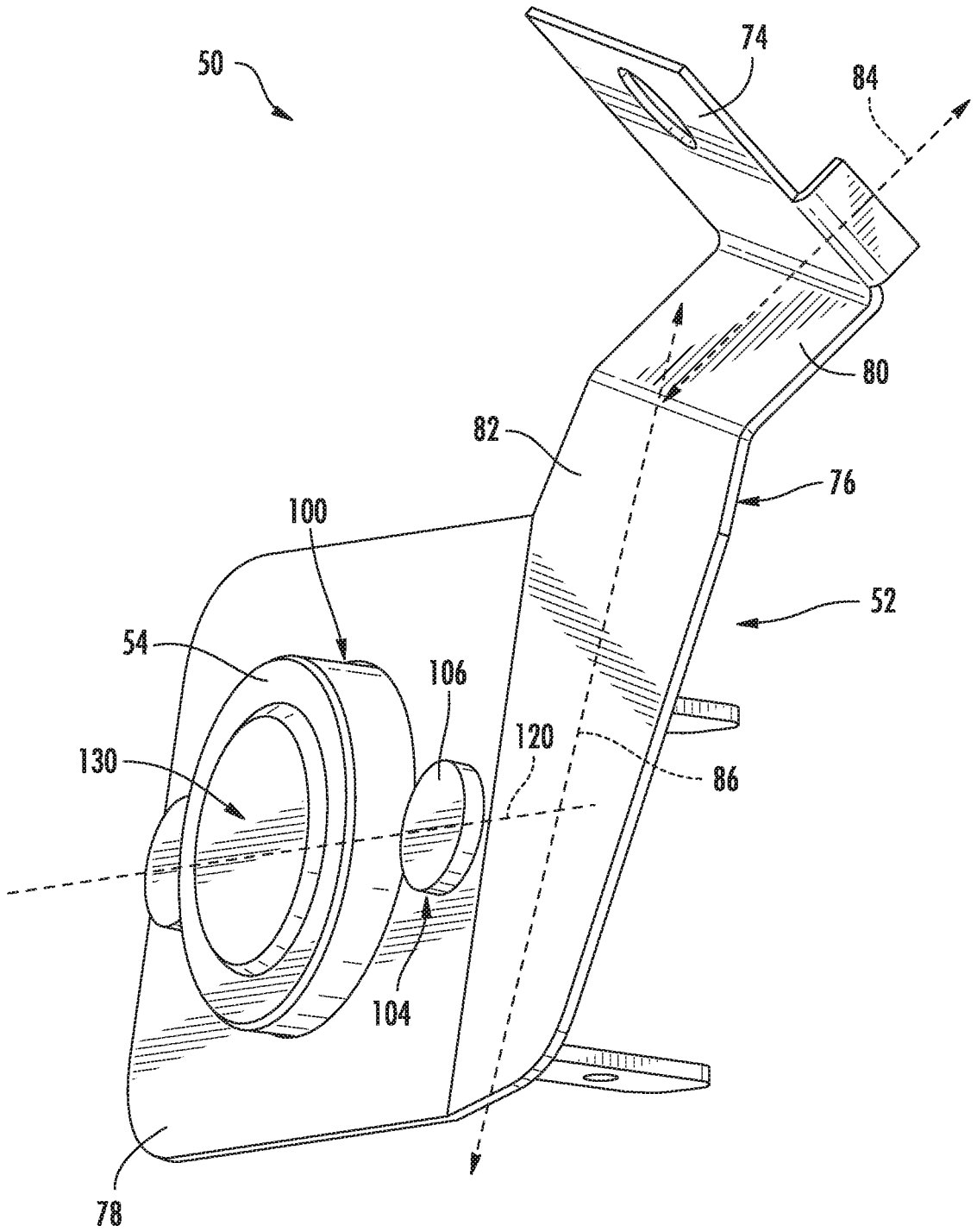
FIG. 8 provides a perspective view of the exemplary switch assembly of FIG. 6 with the rest of the cooktop appliance removed for clarity.
Figure 9:
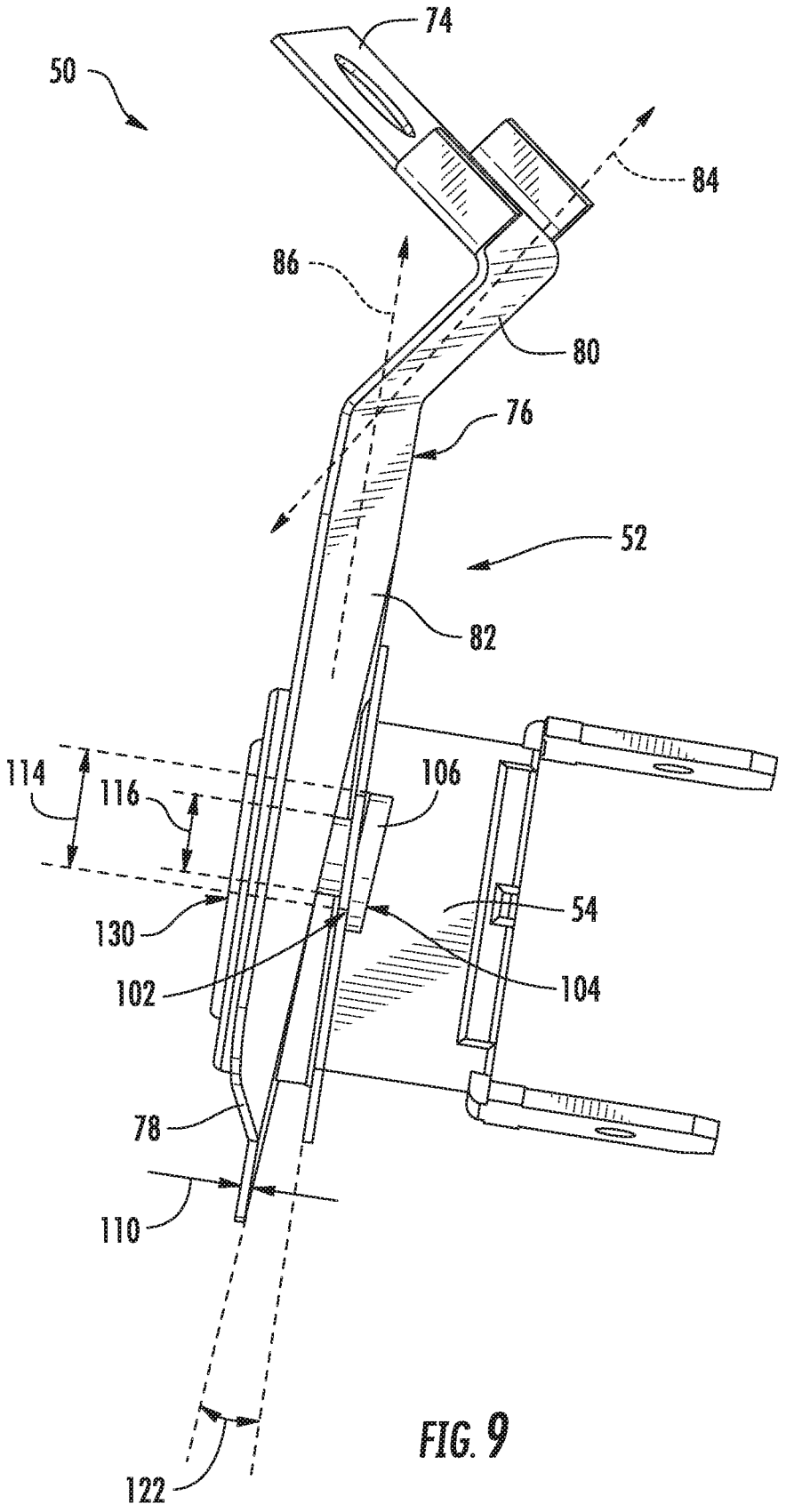
FIG. 9 provides another perspective view of the exemplary switch assembly of FIG. 6 with the rest of the cooktop appliance removed for clarity.

As best shown in FIGS. 7 through 9, elongated pins 104 include two endcaps 106 positioned on opposite ends of elongated pins 104 to prevent elongated pins 104 from falling out of apertures 102. In this regard, elongated pins 104 are similar to rivets, but define a pin length 108 measured between the two endcaps 106 that is long enough to provide some movement of temperature switch 54 as described herein. In this regard, for example, pin length 108 may be greater than two times a thickness 110 of mounting plate 78. According to another embodiment, for example, pin length 108 is approximately 0.090 inches. It should be appreciated that any suitable size and position of elongated pins 104 may be used according to alternative embodiments.

In addition, to allow some movement of temperature switch 54 within mounting plate 78, apertures 102 may generally be larger than elongated pins 104. In this regard, for example, each aperture 102 in switch bracket 52 defines a first diameter 114 and each elongated pin 104 defines a second diameter 116. According to exemplary embodiments, a ratio of first diameter 114 to second diameter 116 is between about 1.05 and 1.2. For example, according to one embodiment, first diameter 114 is approximately 0.140 inches and second diameter 116 is approximately 0.125 inches.

It should be appreciated that the size and position of apertures 102 and elongated pins 104 may be adjusted to achieve the desired pivotal motion of temperature switch 54. For example, according to the illustrated embodiment, two apertures 102 are spaced apart to define a pivot axis 120 such that temperature switch 54 may pivot about pivot axis 120 to self-align with drip pan 62. In addition, according to the exemplary embodiment, mounting plate 78 and elongated pins 104 are configured such that temperature switch 54 pivots through a pivot angle 122 of between about 5 degrees and 15 degrees. However, configurations defining other pivot axes and pivot angles are possible and within the scope of the present subject matter.

When assembled in an engaged state, temperature switch 54 may contact drip pan 62. For instance, temperature switch 54 may contact outer surface 70 of drip pan 62. A flat face-plate 130 may directly contact a portion of outer surface 70 of concave sidewall 66. Advantageously, temperature switch 54 may be able to quickly detect and respond to variations in temperature at drip pan 62 and electric heating element 30. Moreover, flat face-plate 130 may allow a point of constant contact between concave sidewall 66 and temperature switch 54, regardless of movement or tolerances of drip pan 62.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a top panel;

an electric heating element positioned at the top panel;

a drip pan attached to the top panel and positioned below the electric heating element;

a switch bracket attached to the top panel and defining an aperture having a first diameter; and a temperature switch operably coupled to the electric heating element to limit the power supplied to the electric heating element at a predetermined temperature, the temperature switch being mounted to the switch bracket by one or more elongated pins, each elongated pin passing through the aperture in the switch bracket such that the temperature switch engages the drip pan, wherein each of the elongated pins has a second diameter that is less than the first diameter to permit movement of the temperature switch relative to the switch bracket.

2. The cooktop appliance of claim 1, wherein the switch bracket includes a resilient arm biased towards the drip pan.

3. The cooktop appliance of claim 2, wherein the resilient arm is bent to define a first segment and a second segment, the first segment extending along a first axis and the second segment extending along a second axis not parallel to the first axis.

4. The cooktop appliance of claim 1, wherein each elongated pin comprises two end caps and defines a pin length measured between the two endcaps.

5. The cooktop appliance of claim 4, wherein the pin length is greater than two times a thickness of a mounting plate of the switch bracket.

6. The cooktop appliance of claim 4, wherein the pin length is approximately 0.090 inches.

7. The cooktop appliance of claim 1, wherein the one or more elongated pins comprise two elongated pins that are spaced apart along a pivot axis to allow the temperature switch to pivot about the pivot axis and self-align with the drip pan.

8. The cooktop appliance of claim 1, wherein wherein a ratio of the first diameter to the second diameter is between about 1.05 and 1.2.

9. The cooktop appliance of claim 8, wherein the first diameter is approximately 0.140 inches and the second diameter is approximately 0.125 inches.

10. The cooktop appliance of claim 1, wherein the temperature switch is configured for pivoting through a pivot angle of between about 5 degrees and 15 degrees.

11. The cooktop appliance of claim 1, wherein the temperature switch is electrically connected in series with the electric heating element.

12. The cooktop appliance of claim 1, wherein the drip pan includes a concave sidewall, and wherein the temperature switch includes a flat face-plate in contact with the concave sidewall of the drip pan.

13. The cooktop appliance of claim 1, wherein the temperature switch is a bimetallic temperature switch.

14. A cooktop appliance comprising:

a top panel;

an electric heating element positioned at the top panel;

a drip pan attached to the top panel and positioned below the electric heating element;

a switch bracket attached to the top panel and extending toward the drip pan, the switch bracket comprising a cantilevered mounting plate defining two apertures spaced apart along a pivot axis, each of the two apertures having a first diameter; and a temperature switch mounted to the mounting plate by two elongated pins passing through the two apertures, each elongated pin defining a pin length that is greater than a thickness of a mounting plate of the switch bracket such that the temperature switch may pivot along the pivot axis to self-align with the drip pan, wherein each of the elongated pins has a second diameter that is less than the first diameter to permit movement of the temperature switch relative to the switch bracket.

15. The cooktop appliance of claim 14, wherein the temperature switch is operably coupled to the electric heating element to limit a power supplied to the electric heating element at a predetermined temperature.

16. The cooktop appliance of claim 14, wherein the switch bracket includes a resilient arm defining a first segment and a second segment, the first segment extending along a first axis and the second segment extending along a second axis not parallel to the first axis.

17. The cooktop appliance of claim 14, wherein the pin length is greater than two times the thickness of the mounting plate of the switch bracket.

18. The cooktop appliance of claim 14, wherein a ratio of the first diameter to the second diameter is between about 1.05 and 1.2.

19. The cooktop appliance of claim 14, wherein the temperature switch is configured for pivoting through a pivot angle of between about 5 degrees and 15 degrees.

20. The cooktop appliance of claim 14, wherein the temperature switch is electrically connected in series with the electric heating element.

* * * * *